United States Patent [19]

Ploussios

[11] Patent Number: 4,862,184

[45] Date of Patent: Aug. 29, 1989

[54] METHOD AND CONSTRUCTION OF HELICAL ANTENNA

[76] Inventor: George Ploussios, 4 Hackney Cir., Andover, Mass. 01810

[21] Appl. No.: 88,429

[22] Filed: Aug. 24, 1987

Related U.S. Application Data

[63] Continuation-in-part of Ser. No. 11,736, Feb. 6, 1987, abandoned.

[51] Int. Cl.[4] ..... H01Q 1/36

[52] U.S. Cl. ..... 343/745; 343/895; 29/600

[58] Field of Search ..... 343/895, 749, 745, 750; 336/195, 200, 209; 29/600

[56] References Cited

U.S. PATENT DOCUMENTS 3,638,226 1/1972 Brooks et al. ..... 343/895
4,554,554 11/1985 Olesen et al. ..... 343/895

FOREIGN PATENT DOCUMENTS 720114 12/1954 United Kingdom ..... 343/895

*Primary Examiner*—Rolf Hille
*Assistant Examiner*—Michael C. Wimer
*Attorney, Agent, or Firm*—E. T. Barrett

[57] ABSTRACT

A tunable helical antenna consists of a central support of dielectric material having a helical channel in the outer surface of the support. This channel, which may be square, rectangular or of other shape in cross-section, is plated with a conductive material such as copper. Biasing coaxial cables for controlling the tuning of the antenna are then placed within the channel and the channel sealed by a conductive cover. The plated surface becomes the helical radiating element of the antenna while the leads enclosed in the channel are isolated from r-f currents which are confined to the outer surface of the helix coating and conductive cover. The helical channel in the support may be formed by machining or the support may be molded with the helical channel as an integral part. Either way, precision control over the channel dimensions is readily attained. Pairs of oppositely-poled diodes are connected to spaced points on the radiating element. The conductivity of the diodes is controlled through the biasing cables to adjust the electrical length of the radiating element. The helical channel in the support may be formed by machining or the support may be molded with the helical channel as an integral part. Either way, precision control over the channel dimensions is readily attained.

9 Claims, 1 Drawing Sheet

METHOD AND CONSTRUCTION OF HELICAL ANTENNA

CROSS REFERENCE TO RELATED APPLICATION

This application is a continuation in part of application Ser. No. 07/011,736 filed Feb. 6, 1987 entitled ELECTRICALLY TUNABLE HELICAL ANTENNA.

BACKGROUND OF THE INVENTION

1. Field of the Invention

This invention relates to helical antennas and more particularly to an improved method and construction for such an antenna to permit greater precision of construction and more reliable duplication of antenna characteristics.

2. Description of the Related Art

Both tunable and fixed helical antennas of various types and configurations are known. Usually these antennas have been tuned by short circuiting part of the turns of the helix or by disconnecting a portion of the helix from the antenna circuit. This has been accomplished by electro-mechanical switching means.

Such antenna structures are generally capable of switching at only relatively slow rates, have restricted bandwidth over which the antenna can be tuned, and are generally expensive to construct. Precise tuning is difficult and precision reproducibility is impossible.

The above-referenced application discloses an electrically-tunable helical antenna making use of electronically controlled diode networks that tune the antenna quickly and precisely which are connected across sections of the helical windings in such a manner as to prevent an substantial interference with the operation of the antenna by the control networks. Balanced pairs of diodes of opposing polarity are connected across sections of the helix which when forward biased short-circuit selected sections of the helix to change the electrical length of the antenna. The bias feed lines for operation of the diode are carried within the helix turns, as by using a coaxial cable, and thus are prevented from interfering with the rf currents.

SUMMARY OF THE INVENTION

When tubing or coaxial cable is used to form the turns of the helix, as shown in the above-referenced application, dimensional control of the antenna turns is difficult. The tubular material is distorted by bending it into a helix and the random differences in the resulting dimensions, along with the inevitable variations in spacing of the helix turns make it expense to produce precision antennas.

To provide greater dimensional stability, a central support of dielectric material is provided and a helical channel is formed in the outer surface of the support. This channel, which may be square, rectangular or of other shape in cross-section, is plated with a conductive material such as copper. The bias control cables are then placed within the channel and the channel sealed by a conductive cover. The plated surface becomes the helix of the antenna while the cables enclosed in the channel are isolated from r-f currents which are confined to the outer surface of the helix turns.

The helical channel in the support may be formed by machining or the support may be molded with the helical channel as an integral part. Either way, precision control over the channel dimensions is readily attained.

DESCRIPTION OF THE PREFERRED EMBODIMENTS

Figure 2:
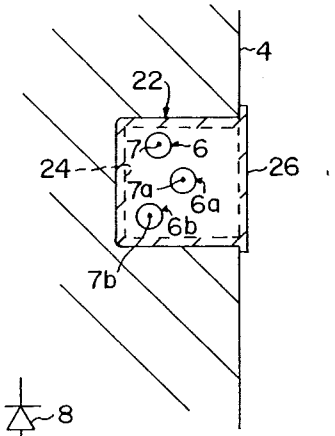
FIG. 2 is an enlarged cross-section of a channel in the support member of FIG. 1 showing the arrangement of the biasing wires.
Figure 3:
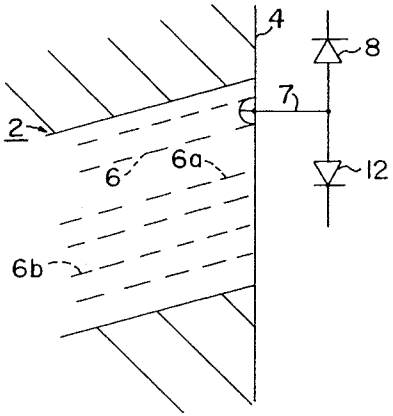
FIG. 3 is a further enlarged view showing the termination of one of the biasing cables.
Figure 1:
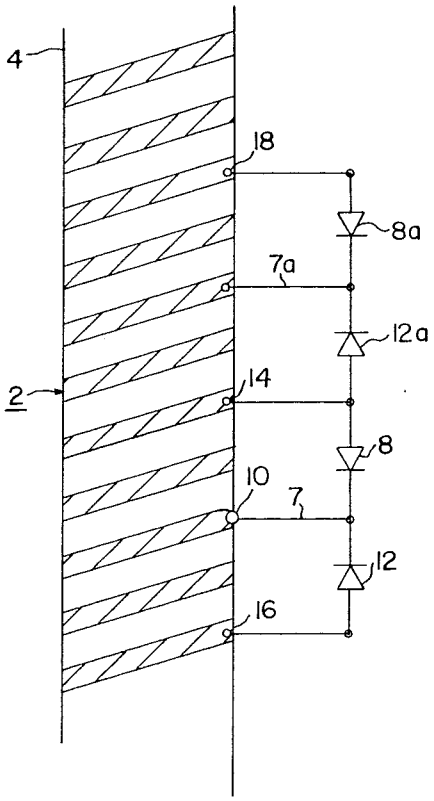
FIG. 1 illustrates diagrammatically a section of an antenna embodying the invention.

The electrical operation of the antenna is described in the above referenced parent application. A helical radiating element, generally indicated at 2, formed of conductive material, is integral with a support 4, which may be a solid rod of plastic or other non-conducting material. A number of coaxial cables, as generally indicated at 6, 6*a* and 6*b* (FIG. 2), are carried within the radiating element 2 and respectively carry biasing leads 7, 7*a*, and 7*b*. The leads 7 and 7*a* are connected respectively to pairs of PIN diodes 8 and 12 and 8*a* and 12a that are connected across sections of the radiating element 2 to permit tuning the antenna to different frequencies. The biasing leads 7 and 7*a* are connected to suitable sources of voltage and current (not shown) for controlling the operation of the diode pair 8 and 12 and diode pair 8*a* and 12*a*, respectively, and thereby the tuning of the antenna. The biasing lead 7 is connected to the oppositely-poled diodes 8 and 12 through an opening 10 in the radiating element 2, and the opposing terminals of the diodes 8 and 12 are connected respectively to the radiating element 2. The outer conductors of the coaxial cables 6 and 6a are connected to the radiating element 2 and, because the inner and outer conductors of each coaxial cable are at the same rf potential, no rf current flows in the control circuits.

When diodes 8 and 12 are back-biased to render them non-conductive, the diodes do not draw any current and the operation of the portion of the radiating element 2 between points 14 and 1 is unaffected. However, when the biasing current on lead 7 is adjusted to apply a forward bias to the diodes to render the diodes 8 and 12 conductive, the low resistance of the diodes presents a short-circuit between the points 14 and 16 rendering that portion of the helix element 2 ineffective and thereby decreasing the electrical length of the antenna. The diodes 8*a* and 12*a* are operated in a similar manner by the bias lead 7*a* to control the operation of the radiating element 2 between points 14 and 18.

There may of course be any desired number of pairs of diodes to control the electrical length of the antenna in the desired increments. The cable 6*b* is available, for example, for one such additional control circuit. In general, the antenna length is adjusted to resonance which corresponds to ¼ wavelength, or odd multiples thereof.

Antennas of this general type can be constructed by using coaxial cable with the outer conductor acting as the radiating element and the inner conductors as the biasing leads. Or the coaxial cable may be placed within a metal tube that acts as the radiating element. Either of these constructions presents difficulties in controlling the accuracies with sufficient precision to permit quantity duplication of the antennas at minimum cost. Variations in the bending action of the coaxial cable or the metal tube and positional variations along the support 4 cause excessive variations in the electrical length of the antenna.

In accordance with this invention, the support 4 is formed with a helical surface channel as generally indicated at 22 in FIG. 2. This channel may be formed in the support by standard machining operations or it may be formed by molding directly into the support 4. An internal coating 24 of copper or other suitable conducting material is then applied by known metallic plating techniques to the inner surfaces of the channel 22. The copper plating is typically 1–3 mils in thickness, but is not critical so long as the thickness is at least several skin depths. The bias cables 6, 6*a*, etc. are then positioned within the channel and the channel is closed by a cover 26 which is formed of copper or other suitable conducting material. At appropriate points along the radiating element 2, an opening is provided for one of the coaxial bias cables, at which point the outer conductor of the cable is terminated and makes electrical contact with the element 2, while the center conductor, or biasing lead, extends from the element 2 to one of the pairs of control diodes.

Because the tuned frequency of the antenna is directly related to the dimensions of the radiating element 2, which in this case is the outer surface of the channel coating 24 (that is, the surface of the coating 24 that is in contact with the support 4) and the cover 26, it is important to control the dimensions of the channel 22 with sufficient precision to meet the requirements of the particular application. This is not difficult, because the dimensions of the helix correspond to the channel 22 formed in the support 4. This can be fabricated accurately either by molding the channel 22 into the support 4 or by machining the channel 22 in the support 4 using standard machining techniques. The bias leads 6, 6a, etc need not be positioned within the channel with any accuracy because the rf currents are confined to the outer surface of the coating 24.

I claim:

1. The method of making a helical antenna section comprising the steps of forming a supporting member of insulating material having a helical channel in the outer surface thereof, plating said channel with a conductive coating, and closing said channel with a helical cover having an outer conductive surface in electrical contact with said conductive coating of said channel, whereby the outer surfaces of said channel coating and said conductive surface of said cover form a radiating element.

2. The method as claimed in claim 1 wherein said conductive coating is predominately copper.

3. The method as claimed in claim 1 including the step of enclosing a biasing cable in said channel prior to closing said channel.

4. The method as claimed in claim 3 including the steps of providing a pair of oppositely-poled diodes, connecting said diodes to spaced points on said radiating element, and connecting said biasing cable to said diodes thereby to control the conductivity of said diodes and change the electrical length of said radiating element.

5. In a helical antenna, the combination comprising a support formed of insulating material and having in its outer surface a helical channel, a radiating element including a conductive coating on the inner surfaces of said channel, and a conductive cover in electrical contact with said coating and closing said channel, whereby the outer surfaces of said cover and said channel coating form a helical radiating element.

6. The combination as claimed in claim 5 wherein said coating is formed predominately of copper.

7. The combination as claimed in claim 6 wherein said coating is approximately three mils in thickness.

8. The combination as claimed in claim 5 including a bias cable within said channel, a pair of oppositely-poled diodes connected to spaced points on said radiating element, and means connecting said bias cable to said diodes thereby to control the conductivity of said diodes and change the electrical length of said radiating element.

9. The combination as claimed in claim 8 wherein said bias cable is a coaxial cable with its outer conductor in electrical contact with said radiating element.

* * * * *